United States Patent [19]

Shirasaka

[11] 4,052,048

[45] Oct. 4, 1977

[54] LONGITUDINALLY INTERFOLDING DEVICE AND METHOD

[75] Inventor: Fumitake Shirasaka, Green Bay, Wis.

[73] Assignee: Paper Converting Machine Company, Green Bay, Wis.

[21] Appl. No.: 666,224

[22] Filed: Mar. 11, 1976

[51] Int. Cl.[2] ..... B41L 1/30

[52] U.S. Cl. ..... 270/40

[58] Field of Search ..... 270/39–41; 221/48, 50

[56] References Cited

U.S. PATENT DOCUMENTS

| | | | |
|---|---|---|---|
| 3,472,504 | 10/1969 | Murphy | 270/40 |
| 3,679,095 | 7/1972 | Nissen | 270/40 |

*Primary Examiner*—Edgar S. Burr
*Assistant Examiner*—A. Heinz
*Attorney, Agent, or Firm*—Tilton, Fallon, Lungmus, Chestnut & Hill

[57] ABSTRACT

A longitudinally interfolding device and method for simultaneously interfolding a pair of partially superposed webs wherein the free margins of the webs are simultaneously over and under folded.

8 Claims, 7 Drawing Figures

LONGITUDINALLY INTERFOLDING DEVICE AND METHOD

BACKGROUND AND SUMMARY

This invention relates to a device and method for longitudinally interfolding webs and, more particularly, to partially superposed webs. This invention has particular utility in providing interfolded facial tissues which are boxed so that as one tissue is removed, another tissue automatically appears.

For many years, the sequentially appearing tissues were manufactured in accordance with U.S. Pat. No. 2,626,145 wherein a pair of webs were transversely severed and interfolded — and in many areas of the world where production capacity is not critical, this procedure is still used. However, in the more industralized areas, the demand for interfolded tissues was sufficiently great to justify more elaborate installations which used the longitudinally folding technique.

The first approach to longitudinal folding is described in U.S. Pat. No. 2,642,279. Although this was superior in productive capacity to the previously employed transverse folding technique, certain of the folding devices were cumbersome. These operated on the principle of completing the interfold of a pair of webs and thereafter unfolding the top web to insert another web edge. It was found more expedient to create a spacing between the two bottom plies of a web stack and insert therein an edge portion of another web — this technique being described in U.S. Pat. No. 3,066,932.

The technique of the '932 patent has been used widely by one manufacturer notwithstanding the fact that it required right and left hand folding devices and the concomitant drawbacks of requiring extensive space and difficulty of threading and alignment. Further refinements have been advanced to the '932 patent technique (as in U.S. Pat. No. 3,291,479) but without altering the principle of using right and left hand folding devices.

Very early in the commercial utilization of the longitudinal interfolding technique, it was realized that substantial advantages could be achieved through the use of folding devices which operated on two webs simultaneously, i.e., eliminating the need for left and right hand folding boards and a simplified threadup procedure. One such approach is set forth in U.S. Pat. No. 3,199,861 which achieved interfolding by using the same handed interfording boards but required pre-folding plates for each web, therefore requiring the use of three forming positions for each two webs.

Another early approach is set forth in U.S. Pat. No. 3,285,599 which was commercially employed in a mill in Canada. In practice, threadup of these folding devices was difficult and time consuming because of the limited spacing between double-biased folding edges and the proximity of the guide. Prior to expansion of its operations into the United States, the patent company of the same manufacturer developed second and third approaches to interfolding. The second approach is according to teachings of U.S. Pat. Nos. 3,472,504 and 3,542,356 which involve a first folding plate which handled two superimposed webs to complete one longitudinal web fold and a partial longitudinal web fold on the opposite side, with the completion of the fold in a succeeding downstream second folding device.

The third approach, according to U.S. Pat. No. 3,841,620, returned to the method of using alternate left and right hand folding devices and was the method employed in the U.S. expansion mill operation. Thereafter, the machine in Canada was similarly altered.

The art therefore appreciated the advantages of a single design forming plate and had many available craftsmen and designers (or artisans and engineers, etc.) skilled in the art who could have realized these advantages — but none did, and more importantly, these advantages were not reflected in any machine and process which has been reduced to practice. The instant invention does achieve these advantages through the use of a novel forming plate and method of operation.

It is appreciated by those skilled in the art that threading of a longitudinally interfolding machine can be a most vexing problem. Where 200 webs must be unrolled from parent rolls axially aligned along one side of the machine, taken over turning bars and thereafter threaded through right and left hand folding devices, it will be immediately appreciated that anything that allows sequential threadup of each pair of webs while running at a slow speed and simplifies this operation is indeed desirable. This is particularly the case where the rolls are usually mounted on driven unwind stands so that any web not immediately threaded causes considerable waste which is not only costly in terms of product, but can create a hazard in the mill.

The construction of the inventive folding plates significantly facilitates the threading operation as well as providing a reliable, foolproof interfolding. The novel structure responsible for these operational advantages, as well as permitting the saving of space, simplification of mechanism and significantly decreasing the problems of alignment, includes two sets of folding edges, each set extending from a point on the margin of the interfolded web path but with the significant difference from what has gone before in providing that one free edge of partially superposed webs is simultaneously and completely folded under the posed webs is simultaneously and completely folded under the superposed portion of the webs while the other is completely folded over this superposed portion.

Other objects and advantages of the invention may be seen in the details of construction and operation set down in the ensuing specification.

DETAILED DESCRIPTION

The invention is described in conjunction with an illustrative embodiment in the accompanying drawing, in which —

Figure 1:
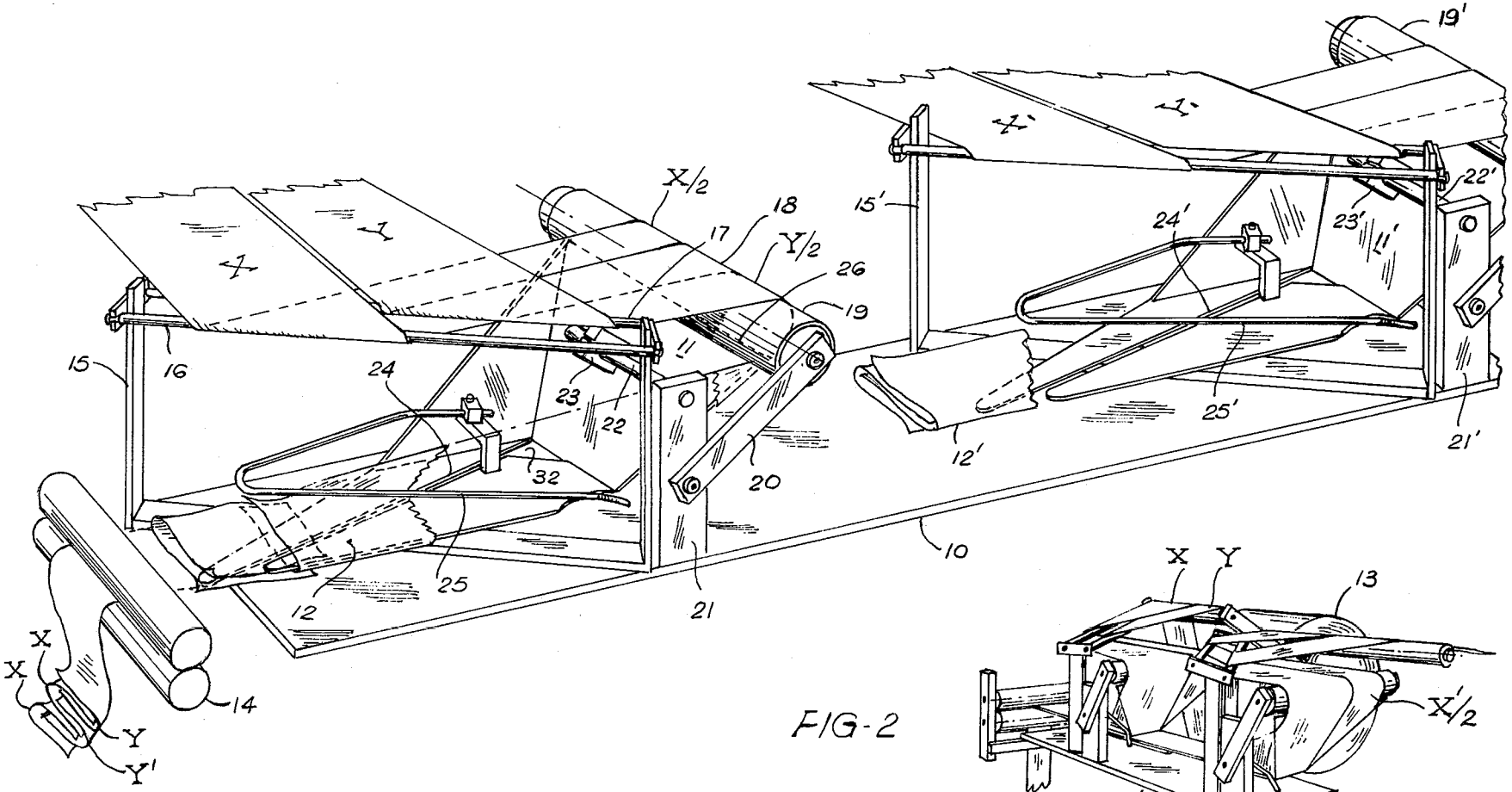
FIG. 1 is a fragmentary perspective view of a portion of a machine embodying teachings of this invention.
Figure 2:
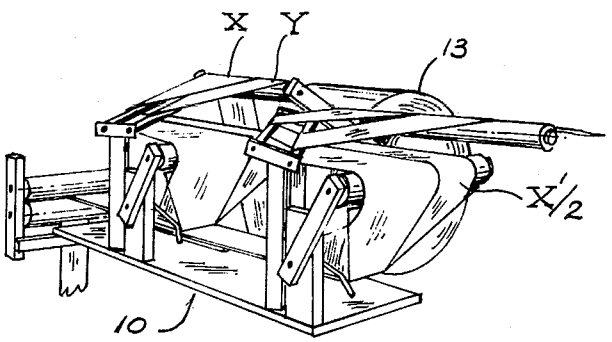
FIG. 2 is another fragmentary perspective view (reduced in scale relative to FIG. 1) and looking at the machine portion of FIG. 1 from the upstream side.

In the illustration given, and with reference to FIGS. 1 and 2, the numeral 10 designates generally the frame of an interfolder. Mounted on the frame are a plurality of identical folding boards as at 11 and 11'. Each folding board 11, 11', etc. is responsible for interfolding a pair of webs X and Y, X' and Y', etc., and simultaneously interlacing a layer of a previously developed substack 12' (see the central portion of FIG. 1) into the substack 12 (see FIG. 7) being developed immediately downstream — as at the board 11.

The webs X and Y, X' and Y', etc. are drawn from parent rolls such as the one designated 13 in FIG. 2 and which provides the webs X and Y. The parent rolls are suitably journaled on unwind stands (not shown) and which, in the commercial interfolding art, are normally driven so as to minimize the tension on the relatively flimsy tissue webs X and Y, etc. Through the simultaneous folding of both webs constituting a single substack 12, it is possible to materially shorten an interfolding line — as compared to lines making use separate right and left hand folding boards. Also, through the use of turning bars, it is possible to derive more than two webs from each parent roll, thereby further cutting down on the equipment required for the interfolding line. The normal interfolded tissue has a width of 4 inches so that prior to folding, each web X and Y has a nominal width of 8 inches. Thus, by having both right and left hand folding operations performed at a single station, it is possible to coordinate the unwind stands to not only materially shorten the length of the line but to operate the same most efficiently.

Figure 6:
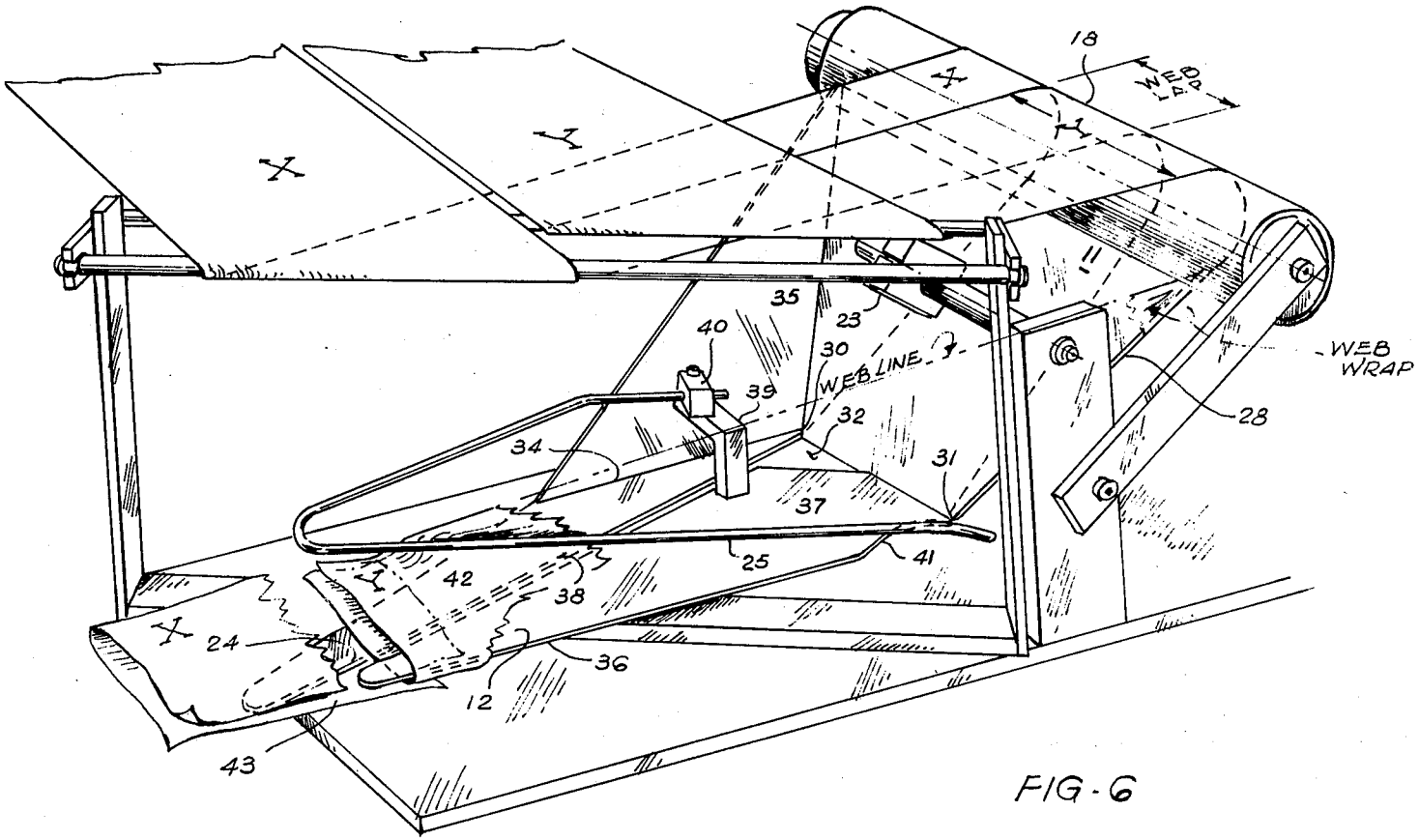
FIG. 6 is a perspective view essentially similar to FIG. 1 (but on enlarged scale) of the folding board of the invention.

For ease of illustration, the machine of FIGS. 1 and 2 features only two folding boards (one of which is illustrated in FIG. 6) — it being appreciated that where a tissue stack is to be developed containing 200 tissues, 100 such folding boards will be employed in a single line. At the downstream end of the line, the completed stack is removed normally through the use of pressure and pull bolt sections which are illustrated schematically by means of draw rolls 14 — see the extreme left hand portion of FIG. 1. Also, the two substacks are shown there with various folded webs identified by appropriate symbols. It will also be appreciated that the frame 10 may be equipped with sections of conveyor interspaced with a plurality of pressure/pull belt sections (omitted for the sake of clarity of presentation) which are employed to conduct the various interfolded and combined substacks downstream toward the exit means 14.

The frame is also equipped, as illustrated, with a superstructure as at 15 relative to the folding board 11 and 15' relative to the folding board 11' for the purpose of supporting turning bars 16 and 17 (relative to the webs X and Y, respectively). The turning bars 16 and 17 are so arranged as to direct the webs X and Y into a lapped relation designated in the central portion of FIG. 1 at 18 — see also FIG. 6. To provide the conventional tissue package, the webs are lapped each one-half of their width leaving unlapped edge portions also one-half the initial web width and designated respectively in the central portion of FIG. 1 by the symbols X/2 and Y/2.

The lapped webs pass around an arcuately contoured element 19 (or 19' relative to the folding board 11') which causes the lapped portions of the webs (as at 18) to adhere to each other and thus maintain the webs in proper alignment during their path of travel longitudinally of the frame 10. The arcuate elements 19 are suitably supported on the frame 10 by means of arms 20 projecting rearwardly (relative to the flow of material) from upstanding posts 21 carried by the frame 10. The posts 21, 21', etc. also provides the support for the folding boards 11, 11', etc. through the provision of laterally extending arms 22 and 22' which are received in split blocks 23 and 23' rigidly connected to the boards 11, 11'. Since all of the elements of a folding board 11 are mounted from one point of suspension 23, the alignment of web substacks (essential to the quality of the finished stack) is accomplished by adjusting the split block 23 transversely on shaft 22. This is advantageously done by a handknob and screw at the end of shaft 22 to provide a running adjustment — important to machine efficiency. Thus, it is a simple matter to align the board at each folding station with those upstream and downstream.

Schematic Representation of Operation

Figure 3:
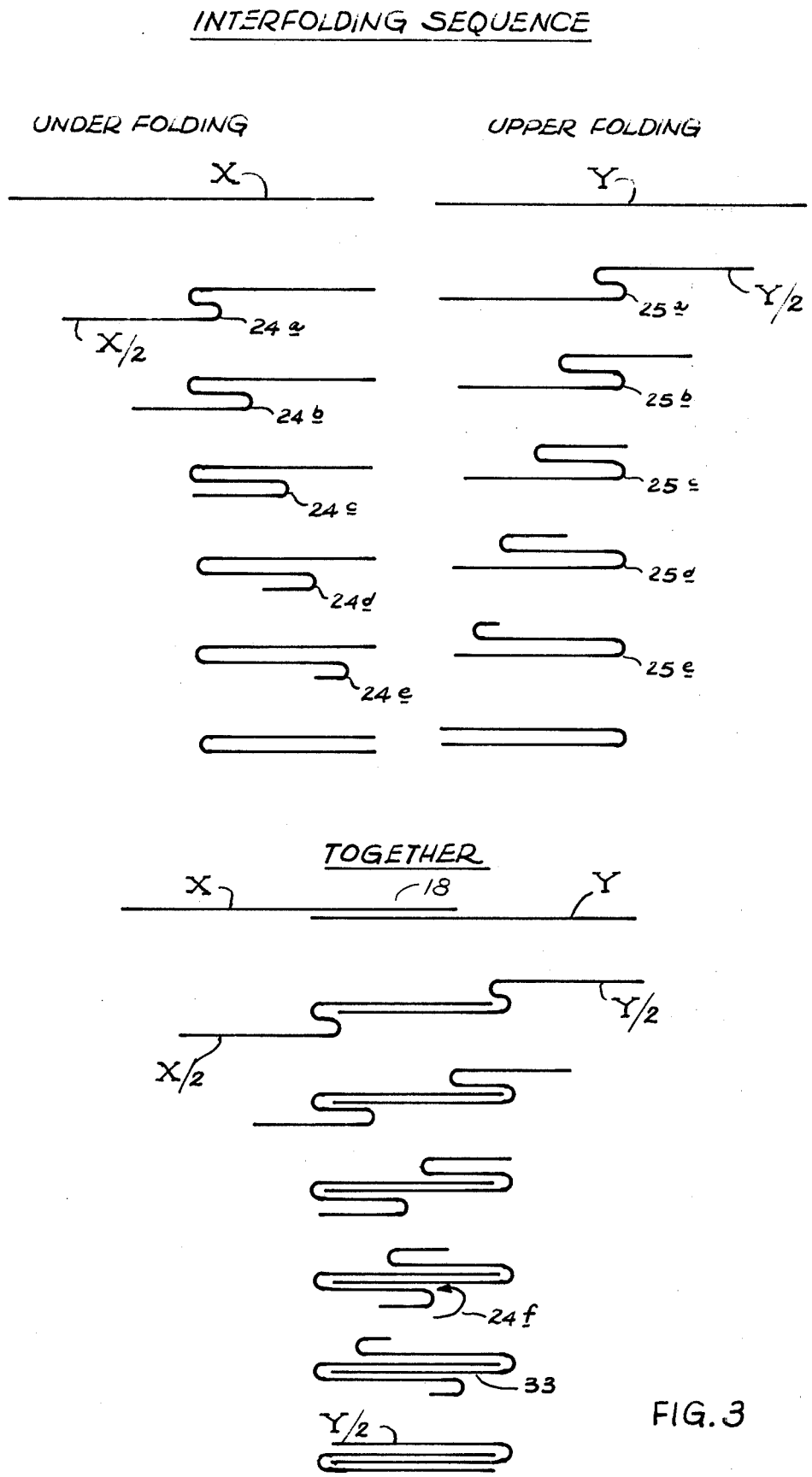
FIG. 3 is a diagram of the interfolding sequence performed according to the invention, the upper portion showing the webs separate for ease of understanding.

Before describing the details of the folding boards 11, 11', reference is first made to FIG. 3 which schematically illustrates an interfolding sequence. The upper portion of FIG. 3 shows the sequence with the webs X and Y separated from each other (for illustration only) while the lower portion illustrates the webs X and Y in the lapped relation as practiced in the invention. The first stage in the interfolding sequence corresponds to the position of the webs X and Y after they have traveled substantially around the arcuate member 19 so that the web X has its lapped portion (in the area 18) above the lapped portion of the web Y. As can be appreciated from the second stage, the lapped one-half of the web X (designated X/2) is in the process of being folded under the lapped portion 18 while the unlapped portion Y/2 of the web Y is in the process of being folded over the lapped portion 18. The underfolding and overfolding just described continues under the control of angled folding edges until there is a complete folding as illustrated in the last stage. The angled folding edge responsible for the underfold in the web X is designated by the numeral 24 (or 24') in FIG. 1 while the angled folding edge for the web Y is designated by the numeral 25, 25', etc. The angularity of the edge is illustrated schematically by the reverse loops in web X as at *24a*, *24b*, *24c*, *24d* and *24e* in the upper left hand portion of FIG. 3. Relative to the web Y, a corresponding designation is employed utilizing the symbol *25a* through *25e*.

Folding Board Structure

Figure 7:
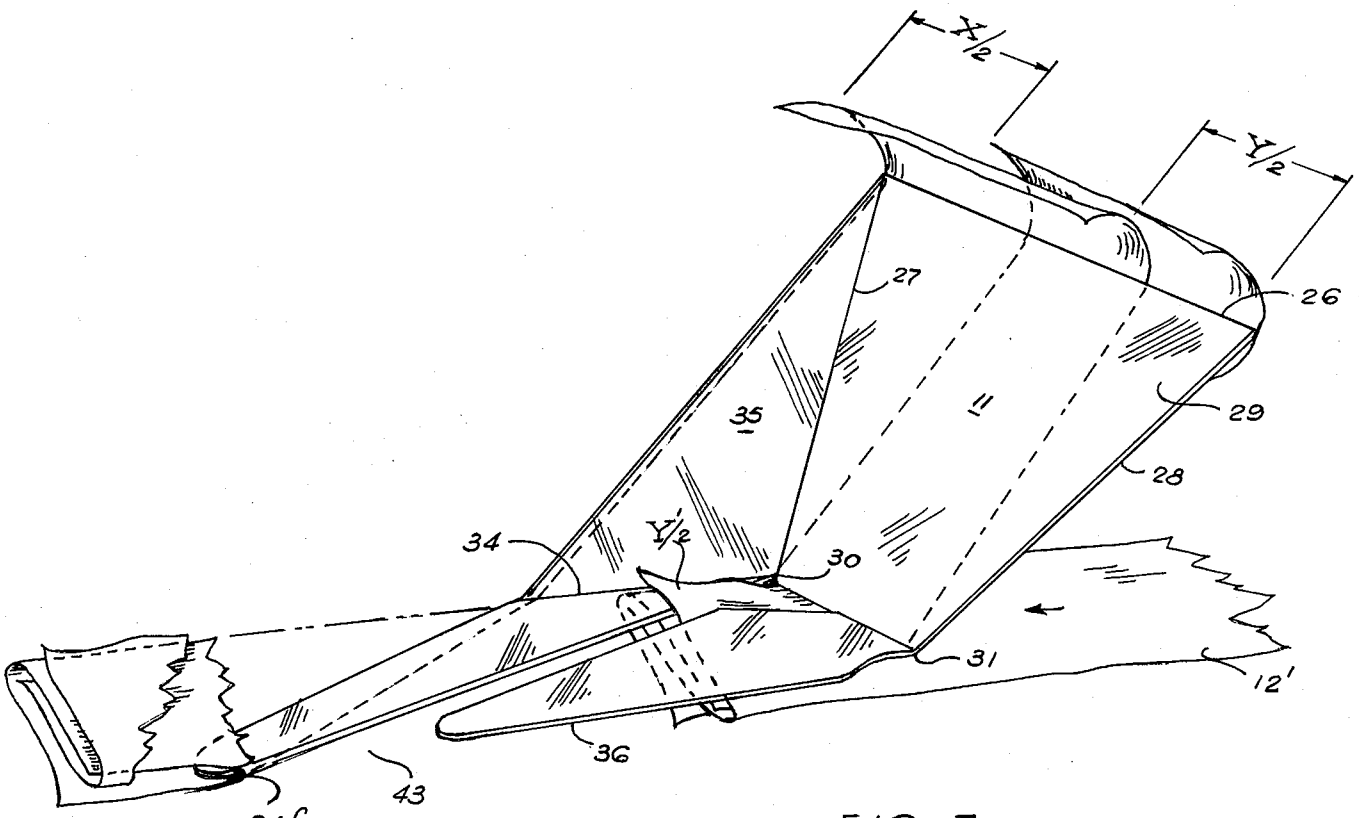
FIG. 7 is a fragmentary perspective view of the inventive folding board shown in the process of threading a previously folded substack of folded webs.

As can be appreciated from FIG. 7, the folding board 11 has an upper edge as at 26 which merges with the arcuate contour of the element 19 (see also the central portion of FIG. 1). For ease of explanation and illustration, the folding board 11 has been illustrated separately as to its operational features relative to the webs X and Y in FIGS. 4 and 5, respectively. The folding board 11 is seen to include first and second downwardly convergent folding edges as at 27 and 28 which extend forwardly relative to web travel in the longitudinal path defined by the frame 10. In the illustration given, these convergent folding edges 27 and 28 are defined by an inclined plate 29 (see FIG. 7). It is this inclined plate 29 which affords the advantageous mounting of the split block 23 previously referred to in connection with FIG. 1. The edges of the plate 29 are continued downwardly to points 30 and 31 which lie respectively on the left and right margins of the folded stack 12. In other words, the points 30 and 31 are spaced apart four inches in the specific illustration given.

Figure 4:
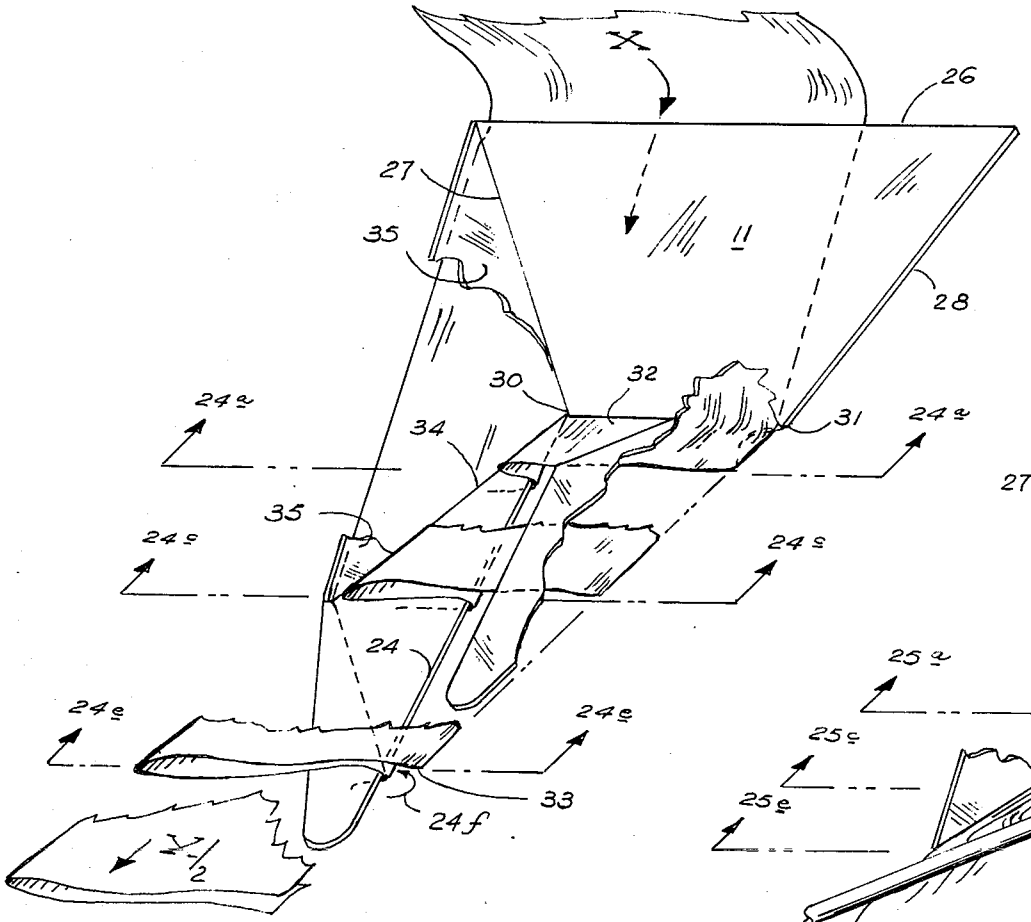
FIG. 4 is a fragmentary perspective view of the left hand portion of the inventive folding board (viewed from downstream) which performs the underfold on web X of FIG. 3, and with certain sight lines applied thereto corresponding to the designations in FIG. 3.

The web X, when entering the folding board 11, as shown in FIG. 4 (as at the line 26 — see also FIG. 7) is unfolded, i.e., has no longitudinal fold. Longitudinal folding commences as the web X travels down the folding board 11 developing the unlapped portion X/2 so designated in FIG. 4. Meanwhile, the other half of the web X has been constrained laterally so as to pass through the gap 32 (see particularly FIG. 6). It should be pointed out that a folding board could be constructed as a framework, i.e., providing only the various edges as by the use of rods, wires, etc., but that, in the illustration given, the folding board has been constructed of plate for ruggedness and reliability. Thus, in such an instance, it is necessary to provide a gap or opening as at 32 to permit the lapped halves of webs X and Y to travel above the angular folding edge 24.

The portion X/2 is folded under the lapped portion of web X in a progressive fashion as it is drawn along the angular fold line 24. Incident to this underfolding (starting from the point 30 and progressing diagonally across the web), there is a turning and urging of the web portion designated by the numeral *24f* as shown schematically in FIGS. 4 and 7. This urging action occurs as the web passes around the angular folding edge 24 and is especially advantageous in threadup of the machine — tending to draw the loose top layer as at Y'/2 (see FIG. 7) into the pocket 33 (see the second to last stage of FIG. 3 and FIG. 4).

It will be appreciated that this phenomenon occurs during the development of the substack 12 — so that threading occurs during substack formation, and utilizes the very fact of substack formation to accomplish threading.

Referring to FIG. 4, the numeral 34 designates a longitudinally or forwardly extending folding or turning edge provided in the folding board 11. The folding edge 34, like the angular folding edge 24 and the convergent folding edge 27, emanates from the marginal point 30, i.e., the three folding edges intersect there. In the illustration given (see particularly FIGS. 6 and 7), a gusset plate 35 is provided to stiffen and rigidify the folding board between the edges 27 and 34. Although these edges do not make a 180° fold, they do change the direction of a portion of the tensioned web.

Figure 5:
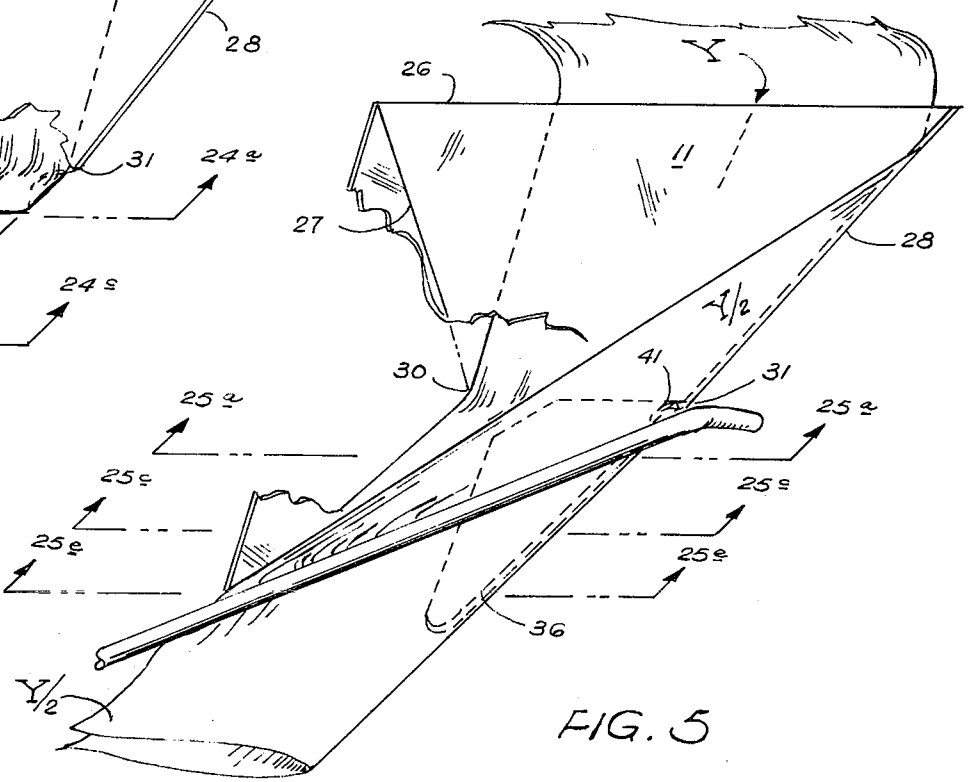
FIG. 5 is a fragmentary perspective view of the right hand portion of the folding board which performs the overfold on web Y of FIG. 3, and with certain sight lines applied.

Reference is now made to FIG. 5 which shows the portion of the folding board 11 operative to longitudinally fold the web Y. Again, the point 31 (like the point 30) is on the margin of the final stack and thus, in effect, bisects the web Y. The web Y is folded around the convergent folding edge 28 to develop the unlapped half Y/2 which then simultaneously is folded around the longitudinally or forwardly extending folding edge 36 and around the angled folding edge 25. As can be best seen in FIG. 6, the folding edge 36 is provided by a forwardly extending tongue 37 provided as an integral part of the folding board 11 — extending forwardly from the line connecting the marginal points 30 and 31. The lapped halves travel below the tongue 37.

Also (as best seen in FIG. 6), the tongue 37 extends forwardly almost to the angled folding edge 24 but is spaced therefrom slightly so as to develop a slot 38. The lateral extension of the tongue 37 provides an advantageous mount for an angled clip 39 for supporting the deformed rod defining the other angled folding edge 25. The rod 25 is secured or clamped within a split block 40 which can be adjustably positioned on the angled clip 39. Thus, the bent rod 25 is adjustably mounted relative to the remainder of the folding board 11 so as to provide a series of folding edges wherein all points of the web have the same overall distance of travel during folding, this folding principle having been well established for years particularly in C-folded tissue and toweling, quarter-fold and dispenser fold napkins, and other folded products. The same folding principle applies to the arrangement of folding edges 27, 34 and 24.

As indicated in the upper right hand portion of FIG. 6, the web Y has a wrap around the convergent folding edge 28 and thus must pass around the point 31 in order to engage the longitudinally extending folding edge 36. The folding edge 25 thus cannot be extended to intersect the point 31 (or else it would prevent passage of the web Y therearound) and for this purpose the portion of the rod 25 approaching the point 31 is offset laterally (compare FIGS. 1, 5 and 6). Additionally, the tongue 37 in the portion immediately adjacent the point 31 is recessed as at 41. However, the major length of the folding edge 25, if extended, would intersect point 31. Thus, the inventive board has two sets of three folding edges, each set forming, in effect, a polyhedral angle.

The slot 38 developed by the cooperation of the tongue 37 and the longitudinally extending portion 42 (see FIG. 6) of the folding board 11 (which portion 42 provides the angled folding edge 24 for the web X), is particularly advantageous during threadup. As can be readily appreciated from a consideration of FIG. 6, the slot 38 terminates in a throat 43, made possible by the shortening of the tongue 37. In operation, it has been found that it is possible to merely grasp the substack 12' from the previous board 11', pull the same under the board 11 and direct the top half web Y'/2 into the throat 43 — whereupon the turning and urging action *24f* (in FIGS. 3, 4 and 7) draws the top layer Y'/2 of the substack 12' into the pocket 33. It has been found that a width of slot (measured perpendicularly to the folding edge 24) from about ⅛ inch to about 3/16 inch provides advantageous results in limiting the induced movement into interfolded relation to only the top layer of the substack 12', i.e., the web portion Y'/2.

Operation

In the practice of the invention a plurality of parent rolls such as that designated 13 in FIG. 2 are mounted along one side of the interfolder inasmuch as each pair of webs follows an identical path to the folding boards 11, 11', etc. With a change in parent rolls from one production run to another, it may be necessary to make minor adjustments in the position of the various folding boards for optimum longitudinal alignment of substacks and this is readily accomplished through the adjustment feature incorporated into the arm 22 and split block 23 (see FIG. 1). Inasmuch as the two sets of folding edges are in predetermined relation to each other, only one adjustment is normally required. In some instances it may be advisable to adjust the elongated rod forming the folding edge 25 but normally once this has been adjusted, that adjustment will remain throughout the use of the interfolder. It should be noted that the interfolder is relatively accessible, i.e., uncluttered, on the side opposite the parent rolls 13. This facilitates threadup — a procedure which oftentimes was most laborious in the past. With the inventive plate, one operator can separately actuate the belt drive for each two-wide parent roll and readily thread both webs without any hesitation — thus saving a large quantity of web material which otherwise would accumulate, as in prior art interfolding machines.

For threadup according to the invention, it is only necessary to bring each pair of webs X and Y, X' and Y', etc. around the turning bars 16 and 17 (see FIG. 1) and into lapped configuration 18 while passing around the arcuate element 19 and then along the folding plates 11, 11', etc. The top half web Y'/2 of substack 12' emanating from the folding plate 11' is merely introduced into the throat 43 of the next succeeding folding board 11. The urging or drawing action characteristic of the web half X/2 in passing around the folding edge 24, in combination with the relatively narrow slot 38 automatically draws the top layer of the substack 12', i.e., the web half Y'/2 into the pocket 33 (see FIG. 3). The distance between the downstream end of the folding board 11' and the upstream end of the folding board 11 may be as little as about 4–8 inches so that not only is a very compact interfolder provided but one where the threading is easily accomplished by one man.

I claim:

1. A method of interfolding elongated webs being advanced along a linear path having longitudinally extending first and second margins, comprising:

lapping a first pair of equal width webs to provide upper and lower webs having a central lapped portion which has longitudinal edges coincident with said margins and unlapped edge portions each one-half the web width outside said margins, pulling said first pair of webs through a folding device positioned in said path and having transversely aligned first and second folding points (30, 31) on said first and second margins respectively, said device having a. a first folding edge (24) extending angularly forwardly in the direction of web movement in said path from said first point (30) across said path to intersect said second margin a spaced distance forwardly of said second point (31) to support thereabove said central lapped portion and to underfold the edge portion of said upper web, b. a second folding edge (36) extending forwardly from said second point (31) coincident with said second margin and terminating a spaced distance rearwardly of the intersection of said first folding edge (24) with said second margin to overfold the edge portion of said lower web, said first and second folding edges (24, 36) being generally co-planar, c. a third folding edge (25) extending angularly forwardly across said path from slightly above said second point (31) to cross above said first margin a spaced distance rearwardly of the intersection of said first folding edge (24) with said second margin to complete the overfolding of the edge portion of the lower web prior to completion of the underfolding of the edge portion of said upper web, pulling a second pair of completely folded webs beneath said device while positioning the overfolded edge portion of the lower web of said second pair in contact with the edge portion of the upper web of said first pair while the same is being folded about said first folding edge whereby the movement of the edge portion of the upper web of said first pair urges and draws the overfolded edge portion of the lower web of said second pair between the edge portion of the upper web of said first pair and the lapped central portion of the lower web of said first pair.

2. An interfolding device adapted to be positioned in a linear path of elongated webs being interfolded, said path having longitudinally extending first and second margins, comprising:

means on said device for lapping a first pair of equal width webs to provide upper and lower webs having a central lapped portion which has longitudinal edges coincident with said margins and unlapped edge portions each one half the web width outside said margins, said device having transversely aligned first and second folding points (30, 31) on said first and second margins respectively, said device also having a first folding edge (24) extending angularly forwardly in the direction of web movement in said path from said first point (30) across said path to intersect said second margin a spaced distance forwardly of said second point (31) to support thereabove said central lapped portion and to underfold the edge portion of said upper web, a second folding edge (36) extending forwardly from said second point (31) coincident with said second margin and terminating a spaced distance rearwardly of the intersection of said first folding edge (24) with said second margin to overfold the edge portion of said lower web, said first and second folding edges (24, 36) being generally co-planar, a third folding edge (25) extending angularly forwardly across said path from slightly above said second point (31) to cross above said first margin a spaced distance rearwardly of the intersection of said first folding edge (24) with said second margin to complete the overfolding of the edge portion of the lower web prior to completion of the underfolding of the edge portion of said upper web, and means operably associated with said device for pulling said first pair of webs through said device and for pulling a second pair of completely folded webs beneath said device while positioning the overfolded edge portion of the lower web of said second pair in contact with the edge portion of the upper web of said first pair while the same is being folded about said first folding edge whereby the movement of the edge portion of the upper web of said first pair urges and draws the overfolded edge portion of the lower web of said second pair between the edge portion of the upper web of said first pair and the lapped central portion of the lower web of said first pair.

3. The device of claim 2 in combination with a plurality of identical devices each positioned in longitudinally spaced relation in said path, elongated frame means beside said path and equipped with a support post for each device, and means interconnecting each device with its associated post for adjusting the alignment of each device relative to the remaining devices.

4. The structure of claim 3 in which the spacing between each device is of the order of about 4–8 inches.

5. An interfolding device adapted to be positioned in a linear path of elongated webs being interfolded, said path having longitudinally extending first and second margins, comprising:

means on said device for lapping a first pair of equal width webs to provide upper and lower webs having a central lapped portion which has longitudinal edges coincident with said margins and unlapped edge portions each one-half the web width outside said margins, said device having:

a pair of downwardly convergent folding edges (27, 28) extending forwardly relative to web travel in said path and terminating respectively at first and second horizontally aligned points (30, 31) on first and second margins of said path, a first folding edge (24) extending angularly forwardly across said path from said first point (30) and intersecting said second margin a spaced distance forwardly of said second point (31) to support thereabove said central lapped portion and underfold the edge portion of said upper web, a second folding edge (36) extending forwardly from said second point (31) and coincident with said second margin, a third folding edge (25) extending angularly forwardly across said path from slightly above said second point (31) to cross above said first margin a spaced distance rearwardly of the intersection of said first folding edge (24) with said second margin, a fourth folding edge (34) extending forwardly from said first point (30) and coincident with said first margin, said third folding edge being positioned above the plane containing said first, second and fourth folding edges.

6. The structure of claim 5 in which said first and fourth folding edges (24, 34) are defined by a first plate-like tongue and said second folding edge (36) is defined by a second plate-like tongue (37), said tongues also being coplanar and being spaced apart to provide a throat (38).

7. The structure of claim 6 in which said device includes a generally trapezoidal plate defining said pair of downwardly convergent folding edges (27, 28) and a gusset plate connecting said generally trapezoidal plate at one of said pair of downwardly convergent folding edges (27) to said first plate-like tongue along said fourth folding edge (34).

8. An interfolding device adapted to be positioned in the path of travel of a pair of half-lapped webs to fold the same, said path having side margins defined by the lap of said webs, comprising a frame:

said frame being equipped with a turning edge extending transversely of said path to turn said half lapped webs, said turning edge terminating in a pair of points, one on each margin, said frame including a pair of generally co-planar plates extending forwardly in said path in the direction of web travel, one of said plates being equipped with a side edge coextensive with one of said said margins, the other of said plates being equipped with an angled side edge extending forwardly from the other of said side margins toward said one side margin, said one plate being spaced from said angled side edge to provide a threading throat, and a folding rod on said frame spaced above said plates and extending angularly across said path from said one margin to the other and intersecting said other margin within the length of said other plate to complete web folding within the length of said device.

* * * * *